US008304696B2

(12) United States Patent
Knight

(10) Patent No.: US 8,304,696 B2
(45) Date of Patent: Nov. 6, 2012

(54) AIR CIRCULATOR FOR AN OVEN

(76) Inventor: David B. Knight, Cape Girardeau, MO (US)

( * ) Notice: Subject to any disclaimer, the term of this patent is extended or adjusted under 35 U.S.C. 154(b) by 580 days.

(21) Appl. No.: 12/427,548

(22) Filed: Apr. 21, 2009

(65) Prior Publication Data

US 2010/0003387 A1 Jan. 7, 2010

Related U.S. Application Data

(60) Provisional application No. 61/077,384, filed on Jul. 1, 2008.

(51) Int. Cl.

| | |
|---|---|
| ***F27D 7/04*** | (2006.01) |
| ***F27D 7/06*** | (2006.01) |
| ***A21B 1/26*** | (2006.01) |
| ***A23B 4/044*** | (2006.01) |
| ***A23B 4/052*** | (2006.01) |

(52) U.S. Cl. ..... 219/400; 99/474; 99/482; 126/21 A

(58) Field of Classification Search ..... None
See application file for complete search history.

(56) References Cited

U.S. PATENT DOCUMENTS

| | | | | |
|---|---|---|---|---|
| 2,510,856 | A | 6/1950 | Bettencourt | |
| 2,558,569 | A | 6/1951 | Koch | |
| 2,833,201 | A * | 5/1958 | Simank | 99/481 |
| 2,883,201 | A | 5/1958 | Simank | |
| 2,956,497 | A | 10/1960 | Bernstein | |
| 3,474,225 | A * | 10/1969 | Leedy | 219/400 |
| 4,344,358 | A * | 8/1982 | Maurer | 99/476 |
| 4,802,459 | A * | 2/1989 | McFadden et al. | 126/41 R |
| 5,747,775 | A * | 5/1998 | Tsukamoto et al. | 219/400 |
| 5,928,541 | A * | 7/1999 | Tsukamoto et al. | 219/400 |
| 6,810,792 | B1 * | 11/2004 | Knight | 99/340 |
| 7,317,173 | B2 * | 1/2008 | Bartelick et al. | 219/401 |
| 7,755,005 | B2 * | 7/2010 | Bartelick et al. | 219/401 |
| 7,766,003 | B2 * | 8/2010 | Kim et al. | 126/21 A |
| 2006/0289436 | A1 * | 12/2006 | Carbone et al. | 219/400 |

* cited by examiner

*Primary Examiner* — Joseph M Pelham
(74) *Attorney, Agent, or Firm* — Senniger Powers LLP

(57) ABSTRACT

An air circulator and an oven including such an air circulator. Ducting has an inlet located toward an upper end of a cooking chamber of the oven and an outlet proximate the lower portion of the chamber. An air mover can move air in the chamber though a fluid passage defined in the ducting from the upper portion of the chamber to the lower portion.

21 Claims, 10 Drawing Sheets

AIR CIRCULATOR FOR AN OVEN

CROSS-REFERENCE TO RELATED APPLICATION

This application claims priority to U.S. Provisional Patent Application Ser. No. 61/077,384 filed Jul. 1, 2008, the entirety of which is hereby incorporated by reference.

FIELD OF THE INVENTION

The present invention generally relates to a heat and air circulator used in an oven.

BACKGROUND OF THE INVENTION

Space in a commercial kitchen is at a premium. Therefore, it is desirable to use the vertical space by making ovens tall in relation to their width and/or depth. However, the vertical elongation of the oven cooking chamber promotes heat stratification within the oven, and uneven cooking. A vertically elongate or vertically oriented oven is one in which the height of the oven cooking or warming chamber is greater than at least one of the horizontal dimensions of the cooking or warming chamber. Moreover, oven configurations promoting circulation of heat may in some circumstances be defeated by improper overloading of the oven with food that blocks the intended circulating flow.

One type of oven that may be vertically oriented in a barbecue oven. However, there are other ovens which are not used for barbeque cooking that can be vertically oriented that experience the heat stratification. Barbecuing is a cooking process that typically involves the cooking of foods by exposing them to relatively low temperature smoke for a number of hours. The structure used for barbecuing typically includes a heating or fire chamber, a cooking chamber and a conduit or flue through which smoke and heated combustion gases are transported from the fire chamber to the cooking chamber. Smoke and heat is produced by burning a smoke producing substance in the fire chamber such as wood, which is periodically replenished, until cooking is completed. The fire chamber is traditionally located to the side of the cooking chamber because grease often drips from the food being cooked. If the grease contacts the burning fuel, it could ignite. Other ovens besides barbecue ovens may also have remote or confined heating sources. In some cases, blowers or fans in the cooking chamber circulate the heated air and smoke from the fire chamber around the food to heat the food and impart a smokey flavor. However, these fans have not resolved the issue of heat stratification in the cooking chamber.

SUMMARY OF THE INVENTION

In one aspect of the present invention, an oven for cooking food generally comprises a housing having a cooking chamber sized and shaped for receiving the food to be cooked. The cooking chamber has an upper portion and a lower portion. A heating source heats air in the housing. Circulating ducting in fluid communication with the chamber defines a fluid passage having an inlet proximate the upper portion of the chamber and an outlet proximate the lower portion of the chamber. An air mover moves heated air in the chamber through the fluid passage from the upper portion of the chamber to the lower portion of the chamber.

In another aspect of the present invention, an air circulator system for an oven for cooking food generally comprises an upstream duct section defining a first portion of a fluid passage and an inlet of the fluid passage opening in a first direction. A downstream duct section defines a second portion of the fluid passage contiguous with the first fluid passage portion. The downstream duct section defines an outlet of the fluid passage facing in a second direction which is arranged at an angle to the first direction. An impeller located in the downstream duct section is arranged to pull fluid through the inlet in the upstream duct section into the passage and to expel fluid from the fluid passage through the outlet in the downstream duct section.

In yet another aspect of the present invention, a method of cooking food generally comprises heating air in a cooking chamber of an oven in which food is placed. The heated air is moved within the cooking chamber into an inlet of a fluid passage defined by a circulating ducting. The inlet is generally proximate to an upper portion of the cooking chamber. The heated air is expelled from the circulating ducting through an outlet of the fluid passage and into a lower portion of the cooking chamber.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
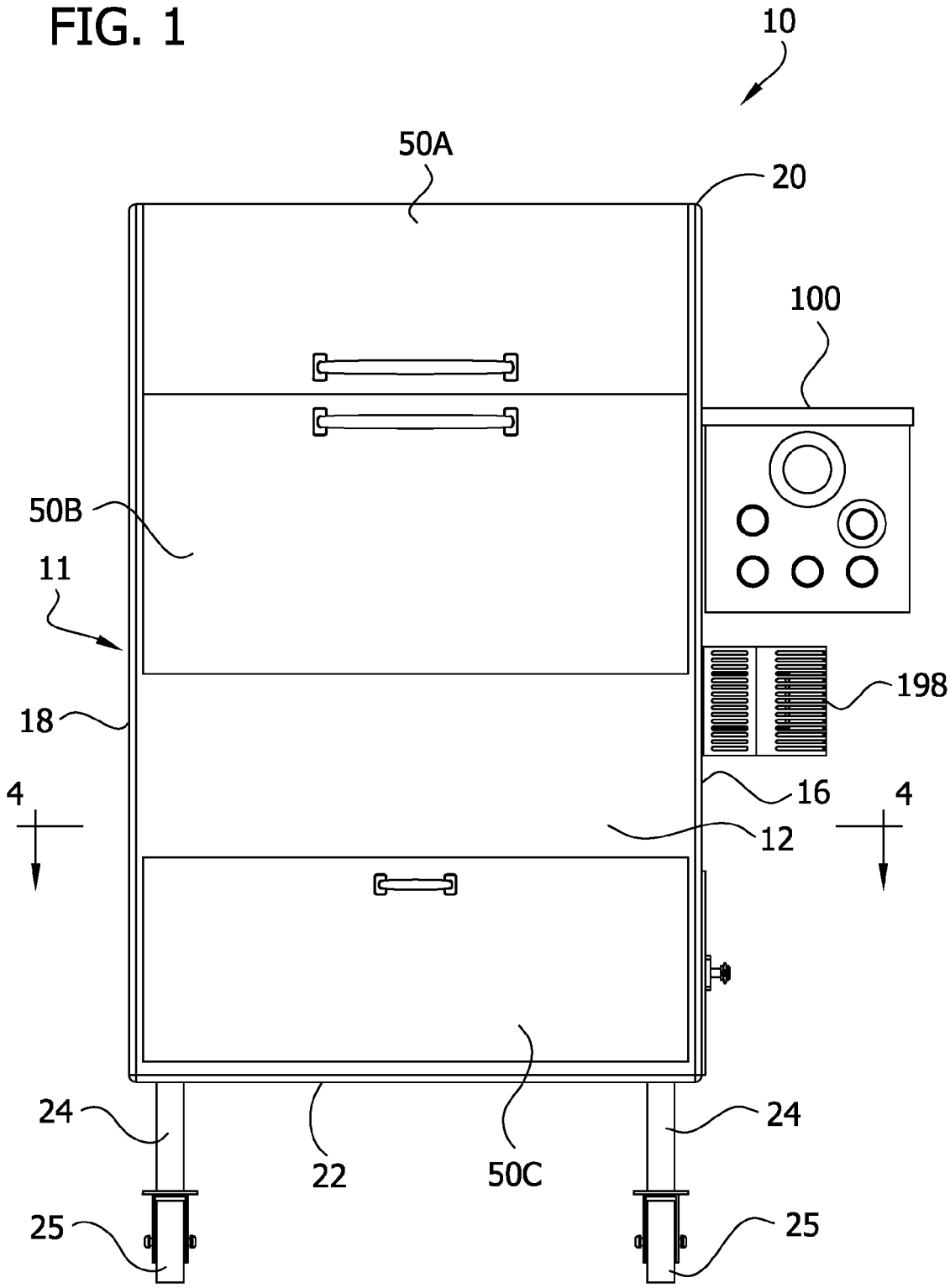
FIG. 1 is a front elevation of a barbecue oven.
Figure 2:
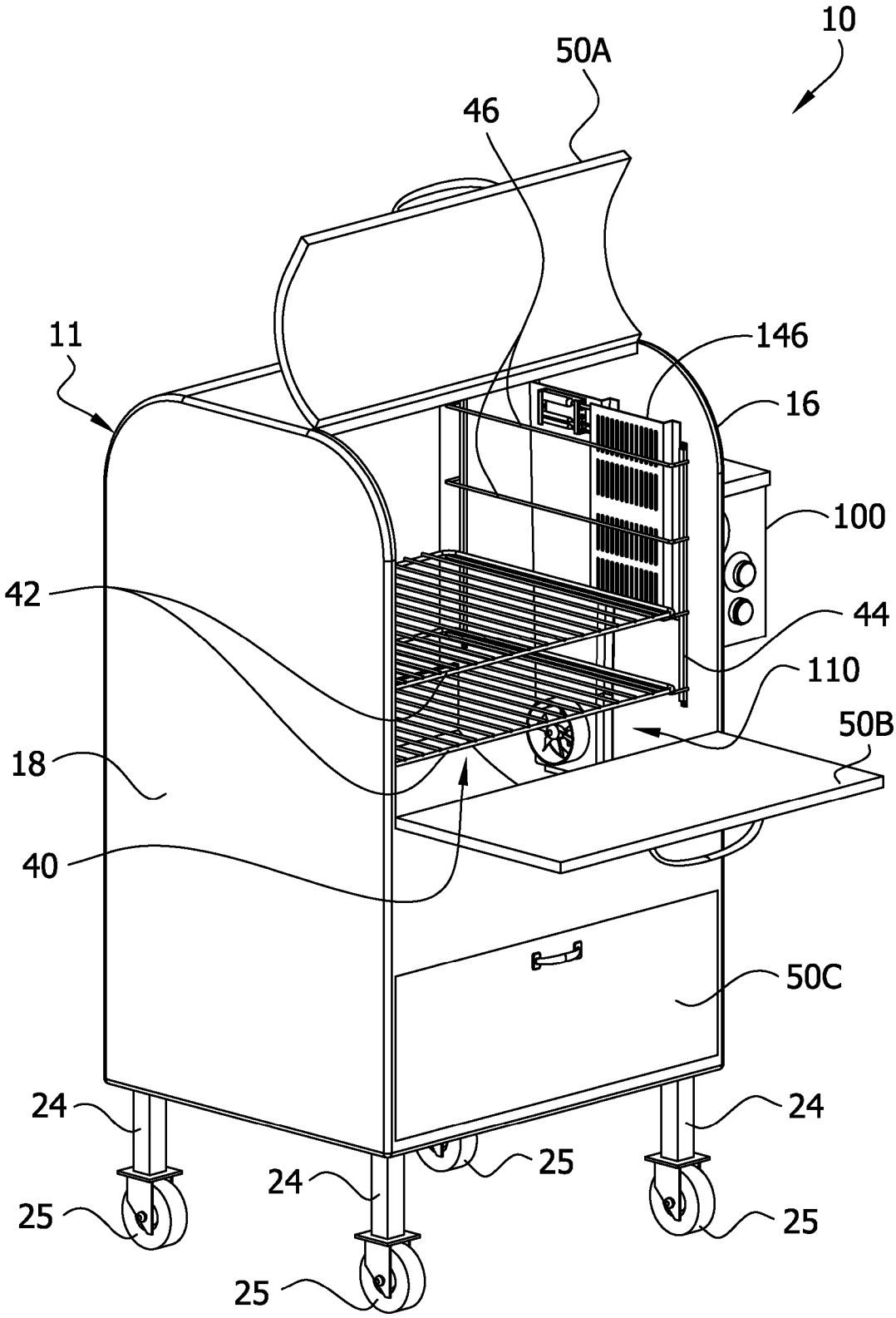
FIG. 2 is a perspective of the barbecue oven with doors of the oven open to show internal construction.
Figure 3:
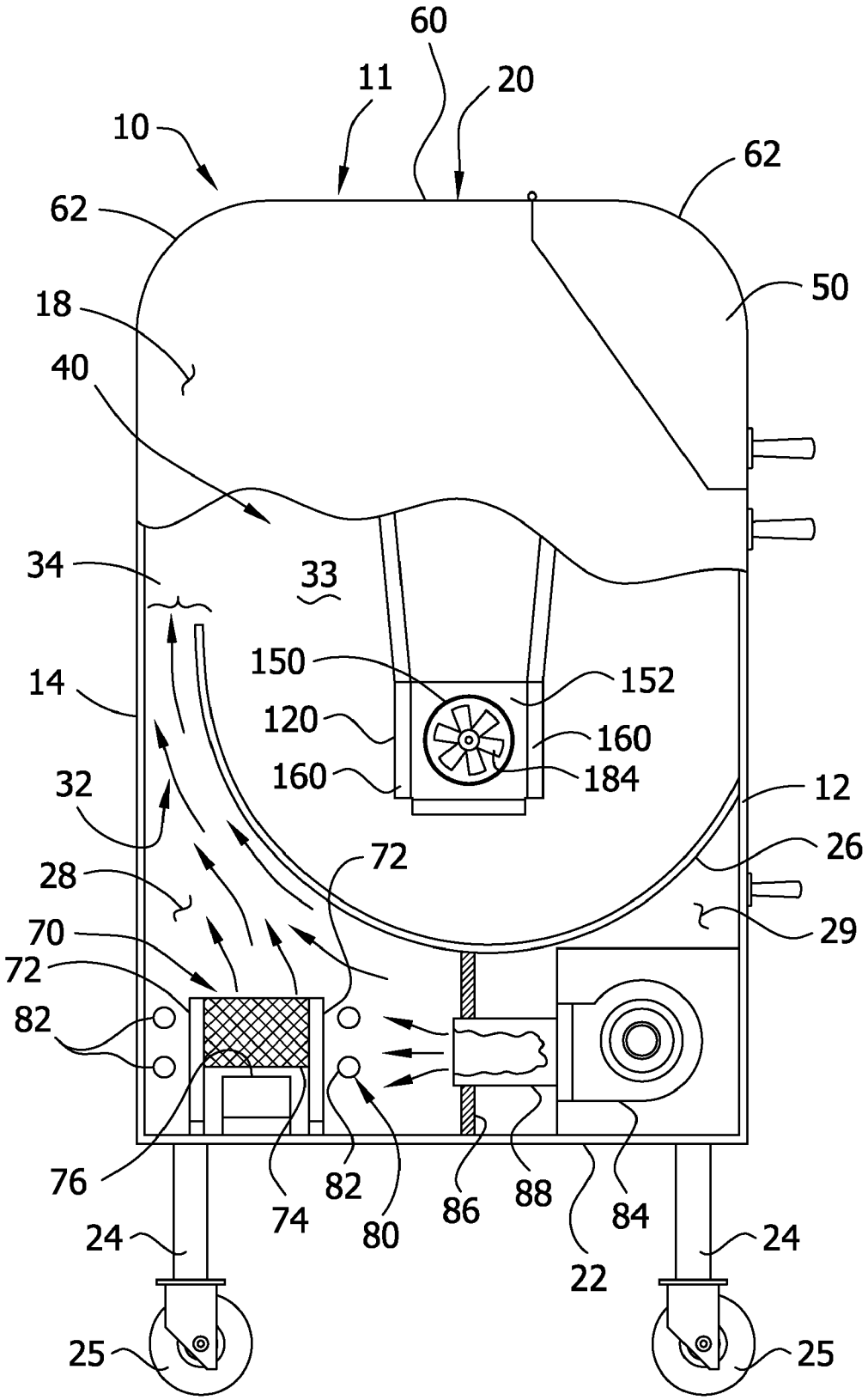
FIG. 3 is a side elevation of the barbecue oven with a side wall broken away and illustrating a flow path of heated air and smoke in the oven.

Referring now to the drawings and in particular to FIGS. 1-3, a barbecue oven that circulates heat and smoke around the food to be cooked is designated generally by reference numeral 10. For purposes of illustration, the invention will be described in conjunction with a barbecue oven, and in particular a barbecue oven of the type disclosed in co-assigned U.S. Pat. No. 6,810,792, the entire disclosure of which is incorporated herein by reference. However, the invention is not be limited to this specific use, as it is instead intended that the invention be used in any application in which circulation of heated air in an oven is required. The oven 10 includes a housing, indicated generally at 11, which comprises a front wall 12, a back wall 14, side walls 16 and 18, a top 20 and a bottom 22. The front, back and side walls 12, 14, 16, 18, constitute wall members which together form vertical walls of the housing 11. The number of wall members forming the vertical wall may be other than described without departing from the scope of the present invention. The housing 11 is supported by legs 24 that include wheels 25 to facilitate transport of the oven 10. The housing 11 is suitably constructed of heat resistant materials such as stainless steel. However, other metals or porcelain coated materials suitable for use in cooking ovens can also be utilized. The housing 11 may have draft portals (not shown), such as in one or both of the sidewall 16, 18. The oven 10 may also include insulation material (not shown) in various parts thereof to maintain temperatures in the oven and to protect users from heat generated by burning fuel in the oven. Insulation may comprise a double-wall construction of the walls 12, 14, 16, 18, 20 and 22 thereof. The double-wall structure may include insulating material between the walls, such as high-temperature mineral wool or other non-combustible material.

A heat flow regulating firewall 26 separates a cooking chamber 30 of the oven 10 from a fire chamber 28 and blower chamber 29 of the oven 10. In one embodiment, the firewall 26 extends between the opposite side walls 16, 18 along a width of the oven 10 and extends from the front wall 12 to near the back wall 14 along a depth of the oven. The fire chamber 28 is in the lower part of the oven beneath the firewall and the cooking chamber 30 is above the firewall. Thus the oven 10 has a generally vertical orientation, meaning that the vertical dimension of the cooking chamber 30 is greater than at least one of its horizontal dimensions. Moreover, the cooking chamber 30 is located above the fire chamber 28. The firewall 26 has a generally arcuate shape with a rear portion that extends upward to form a tapered delivery duct 32 having a throat 34 between the firewall and the back wall 14. The delivery duct 32 is defined by the rear portion of the firewall 26, a portion of the back wall 14 generally opposing the rear portion and sections of the side walls 16, 18 extending between the rear portion and opposing portions of the back wall. A first end or inlet of the delivery duct 32 is located in a horizontal plane between the lowest point of the firewall 26 and the back wall 14. Heated air and smoke from the fire chamber 28 pass through the throat 34 to the cooking chamber 30, as will be more fully described below. The shape of the firewall 26 may be described as a segment of an ellipse (see FIG. 1). One or more flanges (not shown) extending from the firewall 26 to the back wall 14 may secure the firewall to the back wall without substantially blocking the throat 34. The firewall 26 is fixed to the front wall 12 and the side walls 16, 18 of the housing 11 such as by welding. However, the firewall 26 can be fixed to the housing 11 using suitable brackets and fasteners (not shown) without departing from the scope of the invention. It will be appreciated that the firewall 26 and fire chamber 28 may have other configurations, or may be omitted in favor of a different heat source within the scope of the present invention.

Referring to FIG. 2, a food support, indicated generally at 40, is located within the cooking chamber 30. In the illustrated embodiment, the food support 40 includes a plurality of racks 42 (two upper racks being removed in FIG. 2 for clarity) supported on brackets 44 that are secured to the sidewalls 16, 18 of the housing 11. Each bracket includes vertically spaced rails 46, each aligned with a corresponding one of the rails on the bracket 44 on the opposite side wall (16 or 18). The rails of each pair of aligned rails receive opposite edge margins of one of the racks 42 to support the rack in the cooking chamber 30. In the illustrated embodiment the rails 46 are collectively considered to be a "food support mount". Generally speaking, the food support 40 may have various configurations (not shown), including rotisserie-style racks, rotating spits, shelves, or baskets without departing from the scope of the invention. The food support mount would be appropriate for the particular food support being used.

A pair of upper lids or doors 50A, 50B (shown in the open position in FIG. 2) makes up a portion of the front wall 12 and the top 20 of the housing 11 and provides access to the cooking chamber 30. The doors 50A, 50B may have a heat resistant glass window (not shown) located therein to allow the user to monitor the food product being cooked without having to open the door. Also located on the doors 50A, 50B may be a thermometer (not shown) that indicates the temperature inside the oven 10 to aid in regulating the fire in the fire chamber 28. During operation of the oven 10, the doors 50A, 50B are typically in a closed position except when inserting food or retrieving food from the oven 10. A lower door 50C is located at a lower portion of the front wall 12. The lower door 50C provides access to the blower chamber 29.

As configured, the top 20 of the housing 11 has a generally flat section 60 and curved ends 62 joining the front and back walls 12, 14. The curved shape of ends 62 give the top of the enclosure 11 a generally concave shape opening downward toward the cooking chamber 30. The curved shape of the transition between the top 20 and front and back walls 12, 14 also influences the circulation of heated air and smoke within the oven 10 by reducing the accumulation of stagnant pockets of air in the cooking chamber. It will be appreciated that the curved shapes of the illustrated oven are not present in all vertically oriented ovens. However, in situations where the oven is loaded with more than recommended amounts of food, air stagnation and thermal stratification could occur in spite of the beneficial construction of the housing 11 and firewall 26.

In one embodiment, smoke exits the cooking chamber 30 into an exhaust stack (not shown) through a portal (not shown) located in the sidewall 16 so that the portal is below the lowermost rack 42. This location of the portal facilitates removal of smoke in an amount and rate which promotes circulation of smoke and maintenance of smoldering solid fuel in the fire chamber 28. Thus, food in the oven is properly cooked and flavored by the smoke without being over-exposed to the heat and smoke. There may be more than one portal and exhaust stack within the scope of the invention. Other ways for venting smoke from the cooking chamber 30 are contemplated without departing from the scope of the invention.

Figure 4:
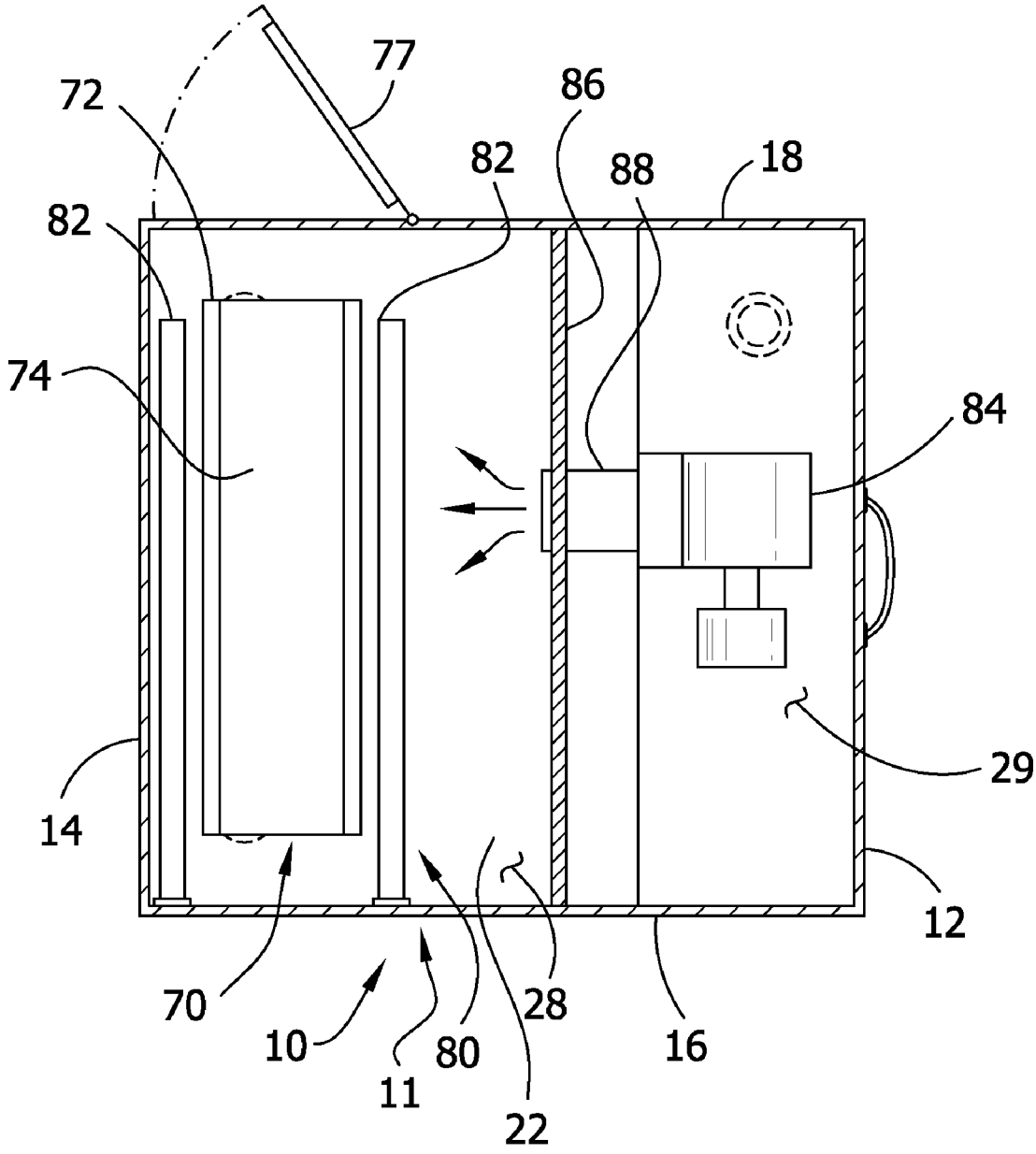
FIG. 4 is a section taken in the plane including line 4-4 of FIG. 1.

The fire chamber 28 contains a fuel vessel, broadly a heat source, generally indicated at 70. In the illustrated embodiment, the fuel vessel is a solid fuel vessel that holds combustible material such as wood logs, wood chips, lump charcoal, compressed charcoal, wood pellets, and the like. The heat source 70 can also be an electric or even gas heating source without departing from the scope of the invention. In such case, the fuel vessel 70 may contain a relatively small quantity of a smoke producing material such as hickory wood. It is also to be understood that no smoke producing material or vessel containing such material need be present within the scope of the present invention. The vessel 70 includes downwardly extending side walls 72 that engage the bottom 22 of the housing 11 to maintain the vessel 70 in its proper position and a substantially planar vessel bottom 74. As best seen in FIG. 4, the vessel 70 is suitably elongated in shape spanning nearly the entire width of the oven 10. Beneath the solid fuel vessel 70 is a removable ash tray 76 for collecting expended ash material. The ash tray 76 is suitably removable through a side door 77 (FIG. 4) for convenient emptying of the ash.

In one embodiment, the oven 10 includes an ignition device, indicated generally at 80, for igniting the solid fuel. The ignition device 80 desirably ignites the solid fuel without the use of gas or other lighter fluids and sparks, such as a standing or intermittent pilot light. The introduction of lighter fluids can introduce undesirable flavors when used for barbecue cooking. The ignition device 80 includes one or more electric heating elements 82 placed adjacent to the vessel 70 containing the solid fuel and a blower 84 that forces air around the solid fuel to improve combustion of the fuel. The heating elements 82 are suitably rod-shaped and are positioned substantially parallel with the elongated vessel 70 containing the solid fuel. In one embodiment, the heating elements 82 are conventional cal rod type resistive heating elements such as, for example, Chromolux Model TRI-54XX, 240V. However, these heating elements 82 are only exemplary of suitable heating elements and one skilled in the art will understand that other heating elements may be used without departing from the scope of the invention. The heating elements 82 are electrically connected to a suitable power source. The heating elements 82 are desirably placed along side the vessel 70 so that the amount of ash created during combustion and consumption of the solid fuel that comes in contact with the heating elements is reduced. A reflector (not shown) may be placed adjacent the heating elements 82 and outward from the vessel 70 to reflect the radiated heat toward the vessel.

The blower 84 is located in the blower chamber 29 located near the front wall 12 of the housing 11. The blower chamber is separated from the heating chamber 28 by a fire wall 86. The blower 84 directs air into a tube 88 that passes through the fire wall 86 into the fire chamber 28, past the heating elements 82, and through the side walls 72 of the solid fuel vessel 70. The blower 84 may have an electric motor capable of operating at various speeds. A blower can also be a gas-fired power burner (not shown) configured to burn natural gas, LP gas, or other fuel to provide a heat source without departing from the scope of the invention.

In one embodiment, a thermostat 100, broadly a controller, is mounted on the housing 11 and is connected with the heating elements 82 and the blower 84 by electrical wiring and controls (not shown) in a conventional manner. The thermostat 100 is adjusted to maintain a desired temperature within the cooking chamber 30 by controlling the current flowing to the heating elements 82 and the blower 84. Thermocouples 102 (see FIG. 5), broadly temperature sensors, are secured within the cooking chamber 30 and provide temperature input to the thermostat 100. For example and without limitation, the thermocouples may be part of a primary thermostat (e.g., thermostat 100), a secondary thermostat, a thermometer and an upper limit control switch thermostat. The thermostat 100 may be a conventional thermostat such as a Robertshaw 5300-17E and may use simple logic or may receive input from thermocouples and use staged or sequenced logic. When the desired temperature is achieved, (suitably between about 200 degrees F. and about 250 degrees F., the thermostat 100 automatically turns off the heating elements 82 and the blower 84. When the temperature in the cooking chamber 30 falls sufficiently below the desired temperature, such as to a range between about 5 F degrees and about 10 F degrees, the thermostat 100 reenergizes the heating elements 82 and the blower 84, thus reestablishing combustion in the solid fuel and restoring the desired temperature. In this manner, the thermostat 100 controls the heating elements 82 and the blower 84 to restore combustion of the fuel and maintain the air temperature within the oven 10 within a predetermined range.

Figure 5:
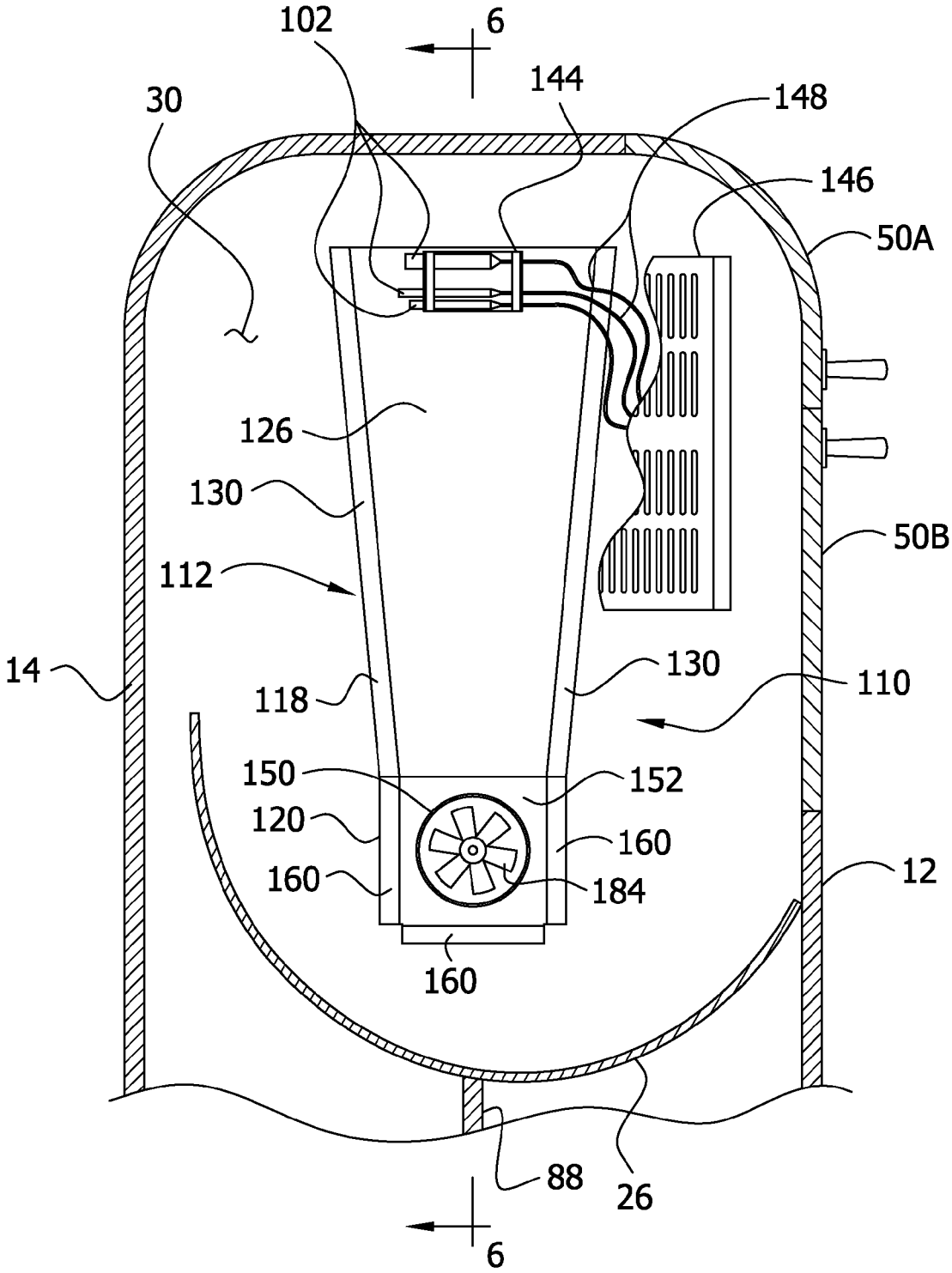
FIG. 5 is a fragmentary section taken in a plane extending between front and back walls of the oven.
Figure 6:
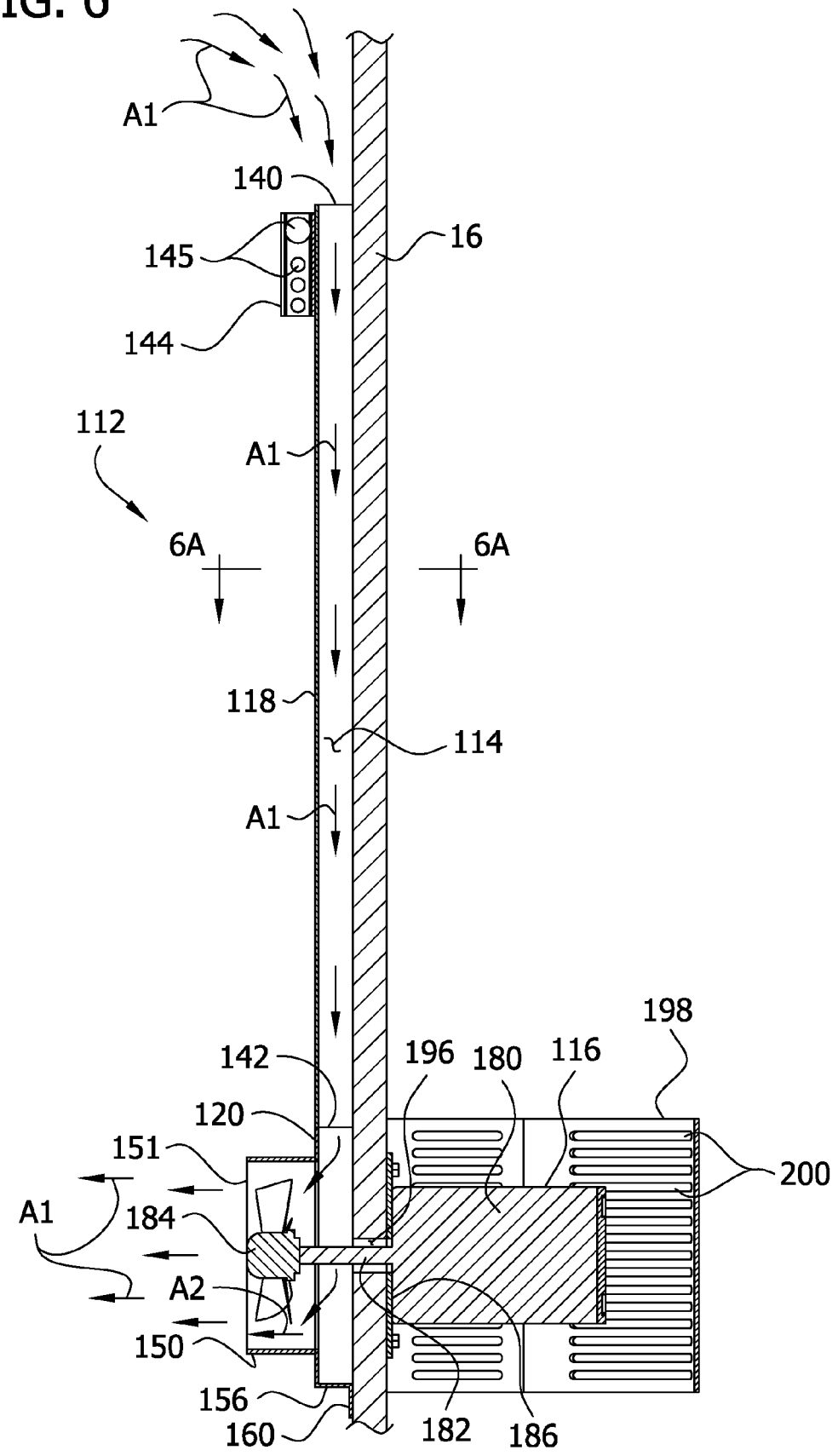
FIG. 6 is a section taken in the plane including the line 6-6 in FIG. 5 and illustrating a circulating flow path.
Figure 6A:
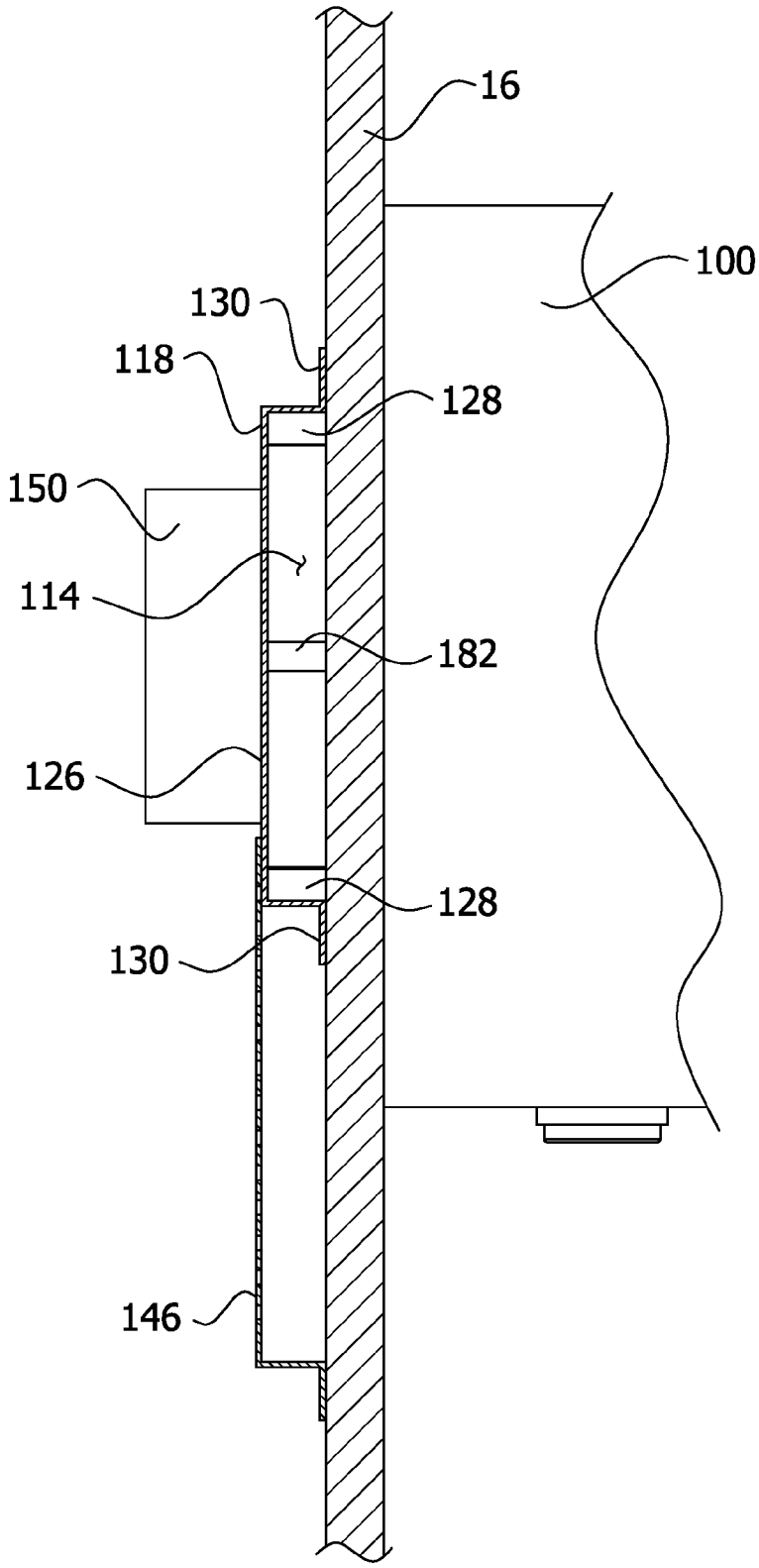
FIG. 6A is a schematic vertical section taken in the plane including line 6A-6A of FIG. 6.

Referring to FIGS. 2 and 5-7, the oven 10 includes a heat and air circulator, generally indicated at 110, for circulating the heated air and smoke within the cooking chamber 30 between upper and lower portions of the cooking chamber to decrease and/or eliminate a substantial temperature differential between the upper and lower portions of the chamber. Referring to FIGS. 6 and 6A, the heat and air circulator 110 generally comprises circulating ducting, generally indicated at 112, defining an enclosed circulating fluid passage 114, and a circulating blower, generally indicated at 116 (broadly, an air mover), in fluid communication with the ducting. The circulating ducting 112 includes an upper duct section, generally indicated at 118 (broadly, an upstream duct section) and a lower duct section, generally indicated at 120 (broadly, a downstream duct section). Referring to FIG. 6, the ducting 112 defines a generally vertical flow path, indicated by arrows A1, of the circulating fluid passage 114, and a generally horizontal flow path, indicated by arrows A2, of the fluid passage 114. Although the duct sections of the illustrated embodiments are formed as separate components, it is understood that, as used herein, the use of the term "ducting" is not limited to separate duct components, but includes a one-piece, integrally formed duct.

Figure 7:
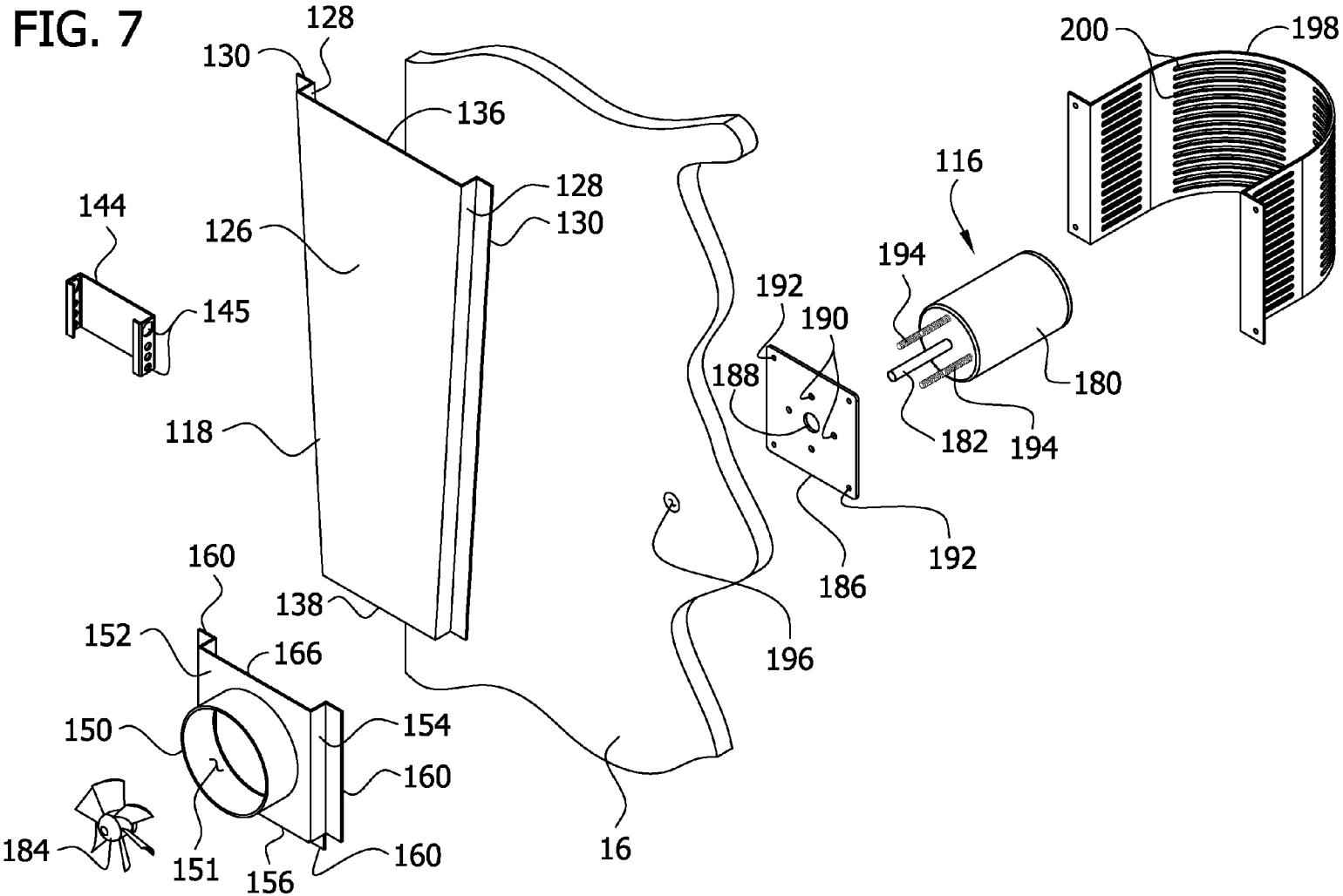
FIG. 7 is an exploded perspective of an air circulator of the oven.

The upper duct section 118 is mounted on the sidewall 16 and has a generally low-profile (see, FIG. 7). The upper duct section 118 includes a generally planar face 126 facing inward toward a center of the cooking chamber 30 and opposite sides 128 together defining a channel. The sides 128 are secured to the sidewall 16 so that the face 126, sides 128 and sidewall defines a first portion of the fluid passage 114. In the illustrated embodiment, the opposite sides 128 of the upper duct section 118 include flanges 130 extending outward from the sides and lying in a plane generally parallel to the face 126 of the duct section. The flanges 130 are attached to the sidewall 16 in a suitable manner such as by threaded fasteners (not shown), welding or in any other suitable manner. Other ways of securing the duct section 118 to the sidewall 16 are within the scope of the invention. In one embodiment, a sealant (e.g., a high temperature silicone) may be used to seal the flange 130 to the side wall 16.

The upper duct section 118 has open upper and lower axial ends 136, 138, respectively (FIG. 7). The open upper axial end 136 and the sidewall 16 of the housing 11 define an inlet 140 (FIG. 6) of the circulating fluid passage 114 through which the heated air and smoke at the upper portion of the cooking chamber 30 enter the passage. In the illustrated embodiment (FIG. 2), the inlet 140 is disposed above the food support 40, e.g., above the uppermost rails 46 that support the food racks 42. The portion of the circulating fluid passage 114 defined by the upper duct section 118 and the sidewall 16 is generally trapezoidal (see FIGS. 5 and 6) and tapers toward the downstream duct section 120. In other words, the fluid passage 114 at the upper duct section 118 has a cross-sectional area that tapers downward from its inlet 140 toward the downstream duct section 120 and the lower portion of the cooking chamber 30. As an example and without being limiting, the inlet 140 and upper duct section 118 may be generally rectangular, having a cross sectional area of between about 11 inches and about 0.5 inches, and the exit opening 142 of the upper duct section 118 may be generally rectangular having a surface area of between about 6.25 inches and about 0.5 inches. Other shapes, sizes and configurations of the upper duct are within the scope of the present invention. The upper duct section 118 may be formed by bending sheet metal, such as stainless steel, into a desired shape.

Referring to FIGS. 5-7, the lower duct section 120 is mounted on the sidewall 16 and has a generally low-profile. The lower duct section 120 includes a channel-shaped portion and a cylindrical outlet portion 150. The channel-shaped portion and the sidewall 16 define another portion of the fluid passage 114 including the vertical flow path A1 of the fluid passage that is generally contiguous with the first portion of the fluid passage that is defined by the upper duct section 118. The channel-shaped portion has generally planar face 152 facing toward the center of the cooking chamber 30 that is generally coplanar with the face 126 of the upper duct section 118. An upper axial end 166 (FIG. 7) of the channel-shaped portion abuts the lower axial end 138 of the upper duct section 118. The abutted axial ends 138, 166 are secured together in a suitable manner to define the fluid passage 114 extending continuously from the upper duct section 118 through the lower duct section 120. In one embodiment, a sealant may be used at the joint of the upper and lower duct sections 118, 120 to seal the fluid passage 114.

The lower duct section 120 has a lower end wall 156 (FIG. 6) extending between the sides 154 and closing a lower axial end of the lower duct. In the illustrated embodiment, the opposite sides 154 and the lower end wall 156 of the lower duct 120 include respective flanges 160 extending outward from the sides and the lower end wall. The flanges 160 lie in a plane generally parallel to the face 152 of the duct section 120. The flanges 160 are attached to the side wall 16 in a suitable manner. In one embodiment, a sealant may be used to seal the flanges 160 with the side wall 16.

The cylindrical outlet portion 150 of the lower duct section 120 extends outward from and generally orthogonal to the face 152 of the channel-shaped portion. The outlet 150 defines a second portion of the fluid passage 114 including the generally horizontal flow path A2, and an outlet opening 151 of the fluid passage. The outlet opening 151 opens in a direction that is perpendicular to the direction which the inlet 140 opens. The outlet 151 is disposed below the food support 40, e.g., below the lowermost rack 42 and directs heated air and smoke horizontally below the food on the lowermost rack 42. The lower duct section may be formed by securing the cylindrical outlet 150 to the face 152 of the channel-shaped portion. The lower duct section 120 may be of other shapes, sizes and configurations within the scope of the invention.

Although the circulating ducting 112 is shown and described as being formed of two separate duct sections 118, 120 it is understood that the circulating ducting may be formed as an integral, one-piece structure. Alternatively, the ducting 112 may comprise any number of separate duct sections secured to one another in any suitable manner to form circulating ducting. It is also understood that the ducting 112 may take on other shapes, sizes and configurations within the scope of the invention.

Referring to FIGS. 6 and 7, the circulating blower 116 of the air circulator 110 includes a blower motor 180, a driveshaft 182 operatively connected to the motor for rotation about its axis, and a blade or an impeller 184 axially secured to the driveshaft. In the illustrated embodiment, the blower motor 180 is electrically powered, although other types of motors are within the scope of the invention. The blower motor 180 is mounted on an outer surface of the sidewall 16, outside the cooking chamber 30, using a blower-motor mounting plate 186. The blower-motor mounting plate includes a central driveshaft opening 188, motor-mounting openings 190 located radially around the central driveshaft opening, and plate-mounting openings 192 located generally adjacent to corners of the plate. Threaded fasteners 194 (e.g., bolts) extending outward from an attached end of the motor 180 are inserted through the motor-mounting openings 190. Nuts, or other fastening components (not shown), are threaded onto the fasteners 194 to secure the motor 180 to the mounting plate 186.

The mounting plate 186 is secured to the sidewall 16 of the housing 11 by inserting fasteners (e.g., sheet metal screws) through the plate-mounting openings 192 and into the side wall 16. With the mounting plate 186 mounted on the sidewall 16, the driveshaft 182 extends through a clearance opening 196 in the sidewall and into the fluid passage 114. More specifically, the driveshaft 182 extends through the downstream duct section 120, generally transverse to the vertical flow path A1, and into the cylindrical output portion 150 of the downstream duct section so that the impeller 184 is generally coaxial with the cylindrical output portion. The blower 116 may be referred to as an in-line duct blower because the impeller is received in the ducting 112. Other configurations and arrangements of the blower 116 are within the scope of the invention. For example, the impeller 184 may be disposed at other locations within the fluid passage 114. There may be more than one blower. Moreover, other types of air movers, besides blowers, within the scope of the invention.

The mounting plate 186 allows the motor 180 of the circulating blower 116 to be mounted on the outside of the housing 11 in sealed relation to the passage 114 to prevent heated air and smoke from leaking out of the passage at the location where the motor is mounted to the housing. The attached end of the motor 180 is in generally flush, tight engagement with the mounting plate 186 to prevent air and smoke from leaking out of the passage 114 between the plate and the motor. The mounting plate 186 is in generally flush, tight engagement with the sidewall 16 of the housing 11 to prevent heated air and smoke from leaking out of the passage 114 between the plate and the wall. A heat-resistant sealant may be applied at the juncture of the mounting plate 186 and the motor 180 and the juncture of the mounting plate and the sidewall 16 to further inhibit air and smoke leakage. Other ways of mounting the blower 116 or other type of air mover on the oven 10 are within the scope of the invention.

A motor guard 198 mounted on the sidewall 16 surrounds the blower motor 180. The motor guard 198 is generally U-shaped and includes slits 200 to allow air circulation and to prevent overheating of the motor 180. The motor guard 198 may be formed in a suitable manner such as by bending sheet metal.

In the illustrated embodiment, the thermocouples 102 for regulating the thermostat 100 are mounted on the upper duct section 118 generally adjacent to the upper axial end 136. The thermocouples 102 are secured to a mount 144, which is secured to the upper duct section 118. The mount 144 includes openings 145 for receiving the respective thermocouples. The thermocouples 102 may be secured within the cooking chamber at other locations within the scope of the present invention. Further, a protective screen 146 covers thermocouple tubes and connectors 148 that connect the thermocouples 102 to the thermostat. The screen 146 protects the thermocouple tubes and connectors 148 while also allowing the ambient air of the cooking chamber 30 to flow around the tubes and connectors for more accurate measurements.

In use, the air circulator 110 circulates heated air and smoke within the cooking chamber 30 between upper and lower portions of the cooking chamber to decrease and/or substantially eliminate a temperature differential between the upper and lower portions of the chamber. As such, the heated air and smoke is more evenly distributed vertically within the cooking chamber 30 to prevent or limit disparities between cooking times of food based on their vertical positions in the oven. With the blower 116 powered on during cooking, the blower draws heated air and smoke into the wide inlet 140 of the circulating fluid passage 114 at an upper portion of the cooking chamber 30. More specifically in the illustrated embodiment, the inlet 140 is located above the uppermost rack 42 on which the food is supported so that the heated air and smoke located above the food is drawn into the passage 114. The heated air and smoke are drawn downward within the passage 114 along the vertical flow path A1 and toward the impeller 184 of the blower 116. The impeller 184 expels the heated air and smoke out of the outlet 151 of the passage 114 (e.g., out of the outlet portion 150 of the downstream duct section 120) along the flow path A2 that is generally horizontal, (i.e., generally perpendicular to the vertical flow path A1). In particular, the outlet 151 is disposed below the lowermost rack 42 on which the food is supported so that the heated air and smoke are expelled out of the outlet generally below the food support 40 and all of the food present in the oven.

The blower 116 may operate continuously during the cooking process so that the heated air and smoke are continuously distributed within the cooking chamber 30. Alternatively, the blower 116 may operate on a timer so that it operates at discrete time intervals during the cooking process. In another example, the blower 116 may be configured to activate when a preselected temperature differential between the upper and lower portions of the cooking chamber 30 is measured by sensors (not shown) located in the cooking chamber. Other ways of operating the blower 116 of the air circulator are within the scope of the invention.

Figure 8:
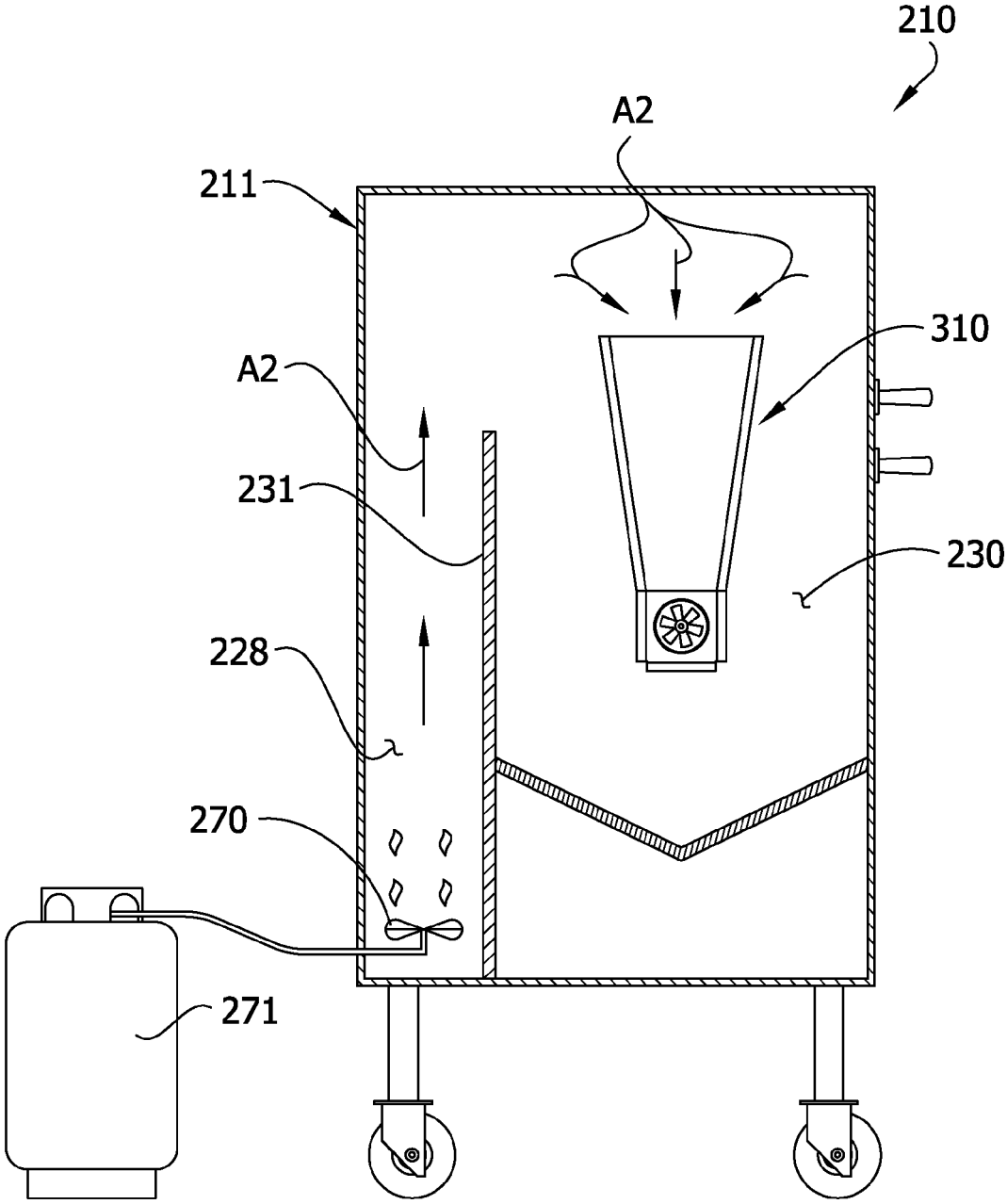
FIG. 8 is a schematic side elevation with parts broken away to show internal construction of a non-barbecue oven using gas heating.

Referring now to FIG. 8 a vertically oriented oven 210 somewhat similar to the oven 10, but not of the type used for barbecue cooking. Parts of the oven 210 corresponding to parts of the oven 10 will be given the same reference numeral, plus "200". The oven 210 includes a housing, indicated generally at 211, which has a more rectangular configuration that the housing 11 of the oven 10. The oven housing 211 defines a cooking chamber 230 in which one or more racks (not shown) for supporting food would be supported. The oven 210 has a remote heating source in the form of a gas burner 270 supplied by a suitable source of gas such as gas tank 271. The burner 270 is located in a burner chamber 228 separated from the cooking chamber 230 by a wall 231. The oven 210 includes a heat and air circulator, generally indicated at 310, for transporting the heated air located at the top of the cooking chamber 230 back to a lower portion of the cooking chamber to decrease and/or eliminate a substantial temperature differential between the upper and lower portions of the chamber. The heated air flows from the burner 270 and some of the heated air flows into the air circulator 310 as indicated by arrows A2. The construction and operation of the air circulator 310 can be the same as the air circulator 110 and will not be described in additional detail.

Figure 9:
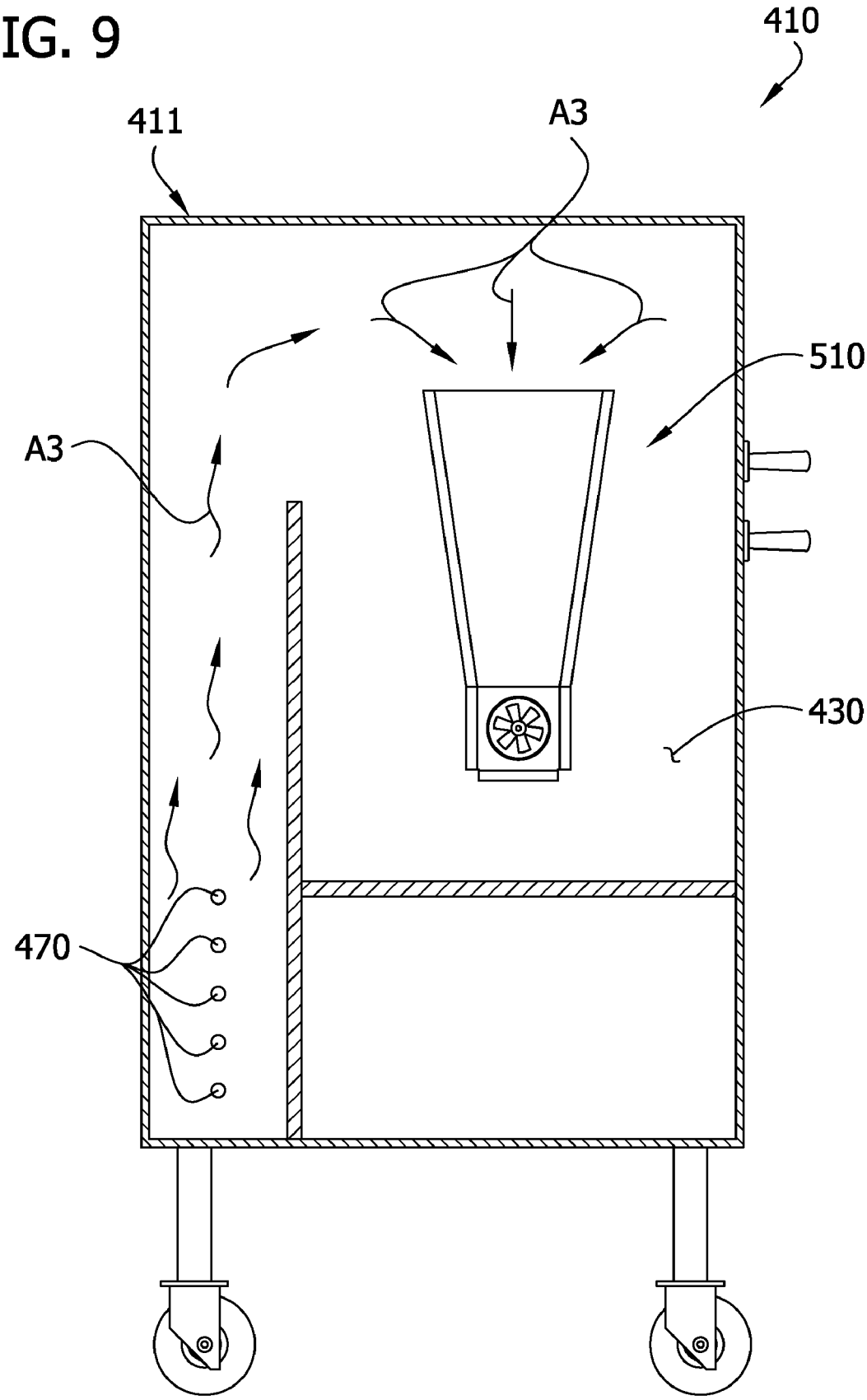
FIG. 9 is a schematic side elevation similar to FIG. 8, but showing an electric heating source.

An oven 410 is shown in FIG. 9 to comprise a housing 411 of a rectangular shape similar to the oven 210 of FIG. 8. Parts of the oven 410 that are similar to the oven 10 of FIGS. 1-7 are designated by the same reference numerals, plus "400". The oven 410 has a very similar construction to the oven 210, except the gas burner 270 is replaced by electric heating elements 470. It will be understood that an oven may have a configuration that differs from either that of the oven 10, the oven 210 or the oven 410 within the scope of the present invention. Heated air flows as indicated by arrows A3 from the heating elements 470. Some of the air is drawn into air circulator 510 and delivered to a lower portion of a cooking chamber 430. As a result temperature gradients within the cooking chamber 430, and particularly gradients in the vertical direction in the chamber, are minimized or substantially eliminated.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A barbeque oven for cooking food comprising:

a housing having a cooking chamber sized and shaped for receiving the food to be cooked, the cooking chamber having an upper portion and a lower portion;

a heating source for heating air in the housing, the heating source being located below the lower portion of the cooking chamber;

circulating ducting in fluid communication with the chamber, the ducting defining a fluid passage having an inlet proximate the upper portion of the chamber and an outlet proximate the lower portion of the chamber;

an air mover for moving heated air in the chamber through the fluid passage from the upper portion of the chamber to the lower portion of the chamber;

a fire chamber in the housing sized and shaped for receiving combustible material therein to generate heat and smoke for cooking the food such that the heating source is located in the fire chamber outside of the cooking chamber;

a firewall separating the fire chamber and the cooking chamber; and a delivery duct extending between the fire chamber and the cooking chamber.

2. An oven as set forth in claim 1 wherein the circulating ducting includes an upstream duct section defining an inlet of the fluid passage and a generally vertical flow path of the fluid passage, a cross-sectional area of the fluid passage tapering along the vertical flow path from the inlet toward the lower portion of the cooking chamber.

3. An oven as set forth in claim 2 wherein the circulating ducting includes a downstream duct section defining an outlet of the fluid passage and a generally horizontal flow path of the fluid passage.

4. An oven as set forth in claim 3 wherein the oven further comprises a food support mount within the cooking chamber for mounting food supports to support the food during cooking, wherein the inlet of the fluid passage is disposed above the food support mount and wherein the outlet of the fluid passage is disposed below the food support.

5. An oven as set forth in claim 4 wherein the food support comprises a plurality of rails spaced apart vertically within the cooking chamber, the plurality of rails including at least one lowermost rail and at least one uppermost rail, wherein the inlet of the fluid passage is disposed above the uppermost rail and wherein the outlet of the fluid passage is disposed below the lowermost rail.

6. An oven as set forth in claim 1 wherein the air mover is proximate the outlet of the fluid passage.

7. An oven as set forth in claim 6 wherein the air mover comprises a blower, the blower comprising a motor, a drive shaft and an impeller.

8. An oven as set forth in claim 6 wherein the ducting includes an upstream duct section defining the inlet of the fluid passage and a generally vertical flow path of the fluid passage, and a downstream duct section defining the outlet of the fluid passage and a generally horizontal flow path, wherein the impeller of the blower is disposed in the downstream duct section for drawing the heated air into the inlet of the ducting and expelling the heated air out of the outlet of the ducting.

9. An oven as set forth in claim 7 wherein the motor of the blower is outside the cooking chamber and the drive shaft extending through the housing into the ducting.

10. An oven as set forth in claim 9 wherein the downstream duct section is generally cylindrical and wherein the impeller is arranged generally co-axially with the downstream duct section.

11. An oven as set forth in claim 7 wherein the oven further comprises a food support mount within the cooking chamber for mounting food supports to support the food during cooking, wherein the inlet of the fluid passage is disposed above the food support mount and wherein the outlet of the fluid passage is disposed below the food support mount.

12. An oven as set forth in claim 11 wherein the food support comprises a plurality of rails spaced apart vertically within the chamber, the plurality of rails including at least one lowermost rail and at least one uppermost rail, wherein the inlet of the fluid passage is disposed above the uppermost rail and wherein the outlet of the fluid passage is disposed below the lowermost the rail.

13. An oven as set forth in claim 7 wherein a cross-sectional area of the fluid passage tapers along the vertical flow path from the inlet toward the lower portion of the cooking chamber.

14. An oven as set forth in claim 1 wherein the delivery duct tapers in a cross sectional area from the fire chamber to the cooking chamber such that heated smoke and air from the fire chamber accelerate from the second end of the duct into the cooking chamber for circulation within the cooking chamber.

15. An oven as set forth in claim 14 wherein the cooking chamber is elongated vertically such that a height of the chamber extending between a lowest point of the firewall and a top wall of the oven is greater than a horizontal dimension of the chamber extending between side walls of the oven.

16. An over as set forth in claim 1 wherein the circulating ducting is disposed inside the cooking chamber.

17. An air circulator system for a barbeque oven for cooking food, the air circulator system comprising:

an upstream duct section defining a first portion of a fluid passage and an inlet of the fluid passage;

a downstream duct section defining a second portion of the fluid passage contiguous with the first fluid passage portion, the downstream duct section defining an outlet of the fluid passage;

an impeller located in the downstream duct section arranged to pull fluid through the inlet in the upstream duct section into the passage and to expel fluid from the fluid passage through the outlet in the downstream duct section;

the upstream duct section being constructed to taper in cross sectional area of the fluid passage toward the downstream duct section.

18. An air circulator system as set forth in claim 17 wherein the first portion of the fluid passage defined by the upstream duct section is generally rectangular in cross section.

19. An air circulator system as set forth in claim 18 wherein the second portion of the fluid passage defined by the downstream duct section is generally circular in cross section.

20. An air circulator system as set forth in claim 19 wherein the impeller is mounted generally coaxially with the second portion of the fluid passage in the downstream duct section.

21. An air circulator system as set forth in claim 17 further comprising an electric motor operatively connected to the impeller for driving rotation of the impeller.

* * * * *